US008272149B2

(12) United States Patent
Cooper et al.

(10) Patent No.: US 8,272,149 B2
(45) Date of Patent: Sep. 25, 2012

(54) ARTICLE OF FOOTWEAR WITH A MIDSOLE STRUCTURE

(75) Inventors: Aaron A. C. Cooper, Portland, OR (US); Marni L. Gerber, West Linn, OR (US); Omar Velazquez, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 244 days.

(21) Appl. No.: 12/577,310

(22) Filed: Oct. 12, 2009

(65) Prior Publication Data

US 2010/0212185 A1 Aug. 26, 2010

Related U.S. Application Data

(60) Provisional application No. 61/104,508, filed on Oct. 10, 2008.

(51) Int. Cl.
*A43B 13/18* (2006.01)

(52) U.S. Cl. ..... 36/102; 36/30 R

(58) Field of Classification Search ..... 36/102, 36/30 R, 25 R, 103, 32 R
See application file for complete search history.

(56) References Cited

U.S. PATENT DOCUMENTS

| | | | | |
|---|---|---|---|---|
| 2,224,590 | A | 12/1940 | Boivin | |
| 5,222,311 | A * | 6/1993 | Lin | 36/28 |
| 7,392,605 | B2 * | 7/2008 | Hatfield et al. | 36/97 |
| 2008/0229617 | A1 * | 9/2008 | Johnson et al. | 36/102 |

FOREIGN PATENT DOCUMENTS

| | | | |
|---|---|---|---|
| WO | 2004028285 | A1 | 4/2004 |
| WO | 2006124116 | A2 | 11/2006 |
| WO | 2008115743 | A1 | 9/2008 |

OTHER PUBLICATIONS

International Search Report, International Application No. PCT/US2009/060361.

* cited by examiner

*Primary Examiner* — Ted Kavanaugh
(74) *Attorney, Agent, or Firm* — Banner & Witcoff, Ltd.

(57) ABSTRACT

An article of footwear is disclosed that includes at least one of an upper and a segmented sole structure. The sole structure may include an insole portion and a plurality of discrete sole elements disposed within an outsole unit. The insole is positioned adjacent the upper and may extend along a longitudinal length of the upper. The sole elements extend from the connecting portion, and the sole elements are separated by a plurality of flexible regions.

9 Claims, 7 Drawing Sheets

ARTICLE OF FOOTWEAR WITH A MIDSOLE STRUCTURE

CROSS-REFERENCE TO RELATED APPLICATION

This application claims application claims the benefit of priority to U.S. application Ser. No. 61/104,508 filed Oct. 10, 2008, the contents therein are incorporated by reference.

BACKGROUND OF THE INVENTION

1. Field of the Invention

The present invention relates to the field of footwear. The invention concerns, more particularly, an article of footwear having an upper and a sole structure with a segmented configuration for flexibility in selected regions and viewing structure.

2. Background

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces and absorbing energy (i.e., imparting cushioning), the sole structure may provide traction and control potentially harmful foot motion, such as over pronation. The general features and configuration of the upper and the sole structure are discussed in greater detail below.

The upper forms a void on the interior of the footwear for receiving the foot. The void has the general shape of the foot, and access to the void is provided by an ankle opening. Accordingly, the upper extends over the instep and toe areas of the foot, along the medial and lateral sides of the foot, and around the heel area of the foot. A lacing system is often incorporated into the upper to selectively increase the size of the ankle opening and permit the wearer to modify certain dimensions of the upper, particularly girth, to accommodate feet with varying proportions. In addition, the upper may include a tongue that extends under the lacing system to enhance the comfort of the footwear, and the upper may include a heel counter to limit movement of the heel.

Various materials may be utilized in manufacturing the upper. The upper of an article of athletic footwear, for example, may be formed from multiple material layers that include an exterior layer, a middle layer, and an interior layer. The materials forming the exterior layer of the upper may be selected based upon the properties of wear-resistance, flexibility, and air-permeability, for example. With regard to the exterior layer, the toe area and the heel area may be formed of leather, synthetic leather, or a rubber material to impart a relatively high degree of wear-resistance. Leather, synthetic leather, and rubber materials may not exhibit the desired degree of flexibility and air-permeability. Accordingly, various other areas of the exterior layer of the upper may be formed from a synthetic textile. The exterior layer of the upper may be formed, therefore, from numerous material elements that each impart different properties to specific areas of the upper.

A middle layer of the upper may be formed from a lightweight polymer foam material that provides cushioning and protects the foot from objects that may contact the upper. Similarly, an interior layer of the upper may be formed of a moisture-wicking textile that removes perspiration from the area immediately surrounding the foot. In some articles of athletic footwear, the various layers may be joined with an adhesive, and stitching may be utilized to join elements within a single layer or to reinforce specific areas of the upper.

The sole structure generally incorporates multiple layers that are conventionally referred to as an insole, a midsole, and an outsole. The insole is a thin, cushioning member located within the upper and adjacent the plantar (lower) surface of the foot to enhance footwear comfort. The midsole, which is traditionally attached to the upper along the entire length of the upper, forms the middle layer of the sole structure and serves a variety of purposes that include controlling foot motions and providing cushioning. The outsole forms the ground-contacting element of footwear and is usually fashioned from a durable, wear-resistant material that includes texturing to improve traction.

The primary element of a conventional midsole is a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

In addition to polymer foam materials, conventional midsoles may include, for example, stability devices that resist over-pronation and moderators that distribute ground reaction forces. The use of polymer foam materials in athletic footwear midsoles, while providing protection against ground reaction forces, may introduce instability that contributes to a tendency for over-pronation. Although pronation is normal, it may be a potential source of foot and leg injury, particularly if it is excessive. Stability devices are often incorporated into the polymer foam material of the midsoles to control the degree of pronation in the foot. Examples of stability devices are found in U.S. Pat. Nos. 4,255,877 to Bowerman; 4,287,675 to Norton et al.; 4,288,929 to Norton et al.; 4,354,318 to Frederick et al.; 4,364,188 to Turner et al.; 4,364,189 to Bates; and 5,247,742 to Kilgore et al. In addition to stability devices, conventional midsoles may include fluid-filled bladders, as disclosed in U.S. Pat. Nos. 4,183,156 and 4,219,945 to Rudy, for example.

SUMMARY OF THE INVENTION

The present invention pertains to an article of footwear with a segmented sole structure.

In one aspect of the invention, an article of footwear includes an upper and a sole structure secured to the upper, the sole structure comprises an outsole unit and a plurality of discrete sole elements disposed within the outsole unit enabling viewing of the sole elements therein. The sole elements being separated by a plurality of flexion regions, the plurality of flexion regions including: a first flexion region in a longitudinal direction with respect to the footwear.

In another aspect, the first flexion region extends through an entire length of the sole structure. The first flexion region can be spaced inward from a lateral side of the sole structure in at least a forefoot region of the footwear. A second flexion region extends in the longitudinal direction, the second flexion region extending through a portion of the length of the sole structure and ending in a metatarsal region of the sole structure; and a plurality of third flexion regions that extend laterally from the medial side to the lateral side of the sole structure.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose an article of footwear 10 in accordance with the present invention. Footwear 10 is depicted in the figures and discussed below as having a configuration that is suitable for athletic activities, particularly running. The concepts disclosed with respect to footwear 10 may, however, be applied to footwear styles that are specifically designed for a wide range of other athletic activities, including basketball, baseball, football, soccer, walking, and hiking, for example, and may also be applied to various non-athletic footwear styles. Accordingly, one skilled in the relevant art will recognize that the concepts disclosed herein may be applied to a wide range of footwear styles and are not limited to the specific embodiments discussed below and depicted in the figures.

Footwear 10 is depicted in FIGS. 1-9 and includes an upper 20 and a sole structure 30. Upper 20 is formed from various material elements that are stitched or adhesively-bonded together to form an interior void that comfortably receives a foot and secures the position of the foot relative to sole structure 30. Sole structure 30 is secured to a lower portion of upper 20 and provides a durable, wear-resistant component for attenuating ground reaction forces and absorbing energy (i.e., providing cushioning) as footwear 10 impacts the ground.

Many conventional articles of footwear exhibit a configuration that controls the motion of the foot during running or other activities. A conventional sole structure, for example, may have a relatively stiff or inflexible construction that inhibits the natural motion of the foot. Upper 20 and sole structure 30 have a structure that cooperatively articulate, flex, stretch, or otherwise move to provide an individual with a sensation of natural, barefoot running That is, upper 20 and sole structure 30 are configured to complement the natural motion of the foot during running or other activities. In contrast with barefoot running, however, sole structure 30 attenuates ground reaction forces and absorbs energy to cushion the foot and decrease the overall stress upon the foot and provide a sense of the ground for movement to strengthen the musculoskeletal performance of a wearer, in particular the foot of a child.

Figure 8:
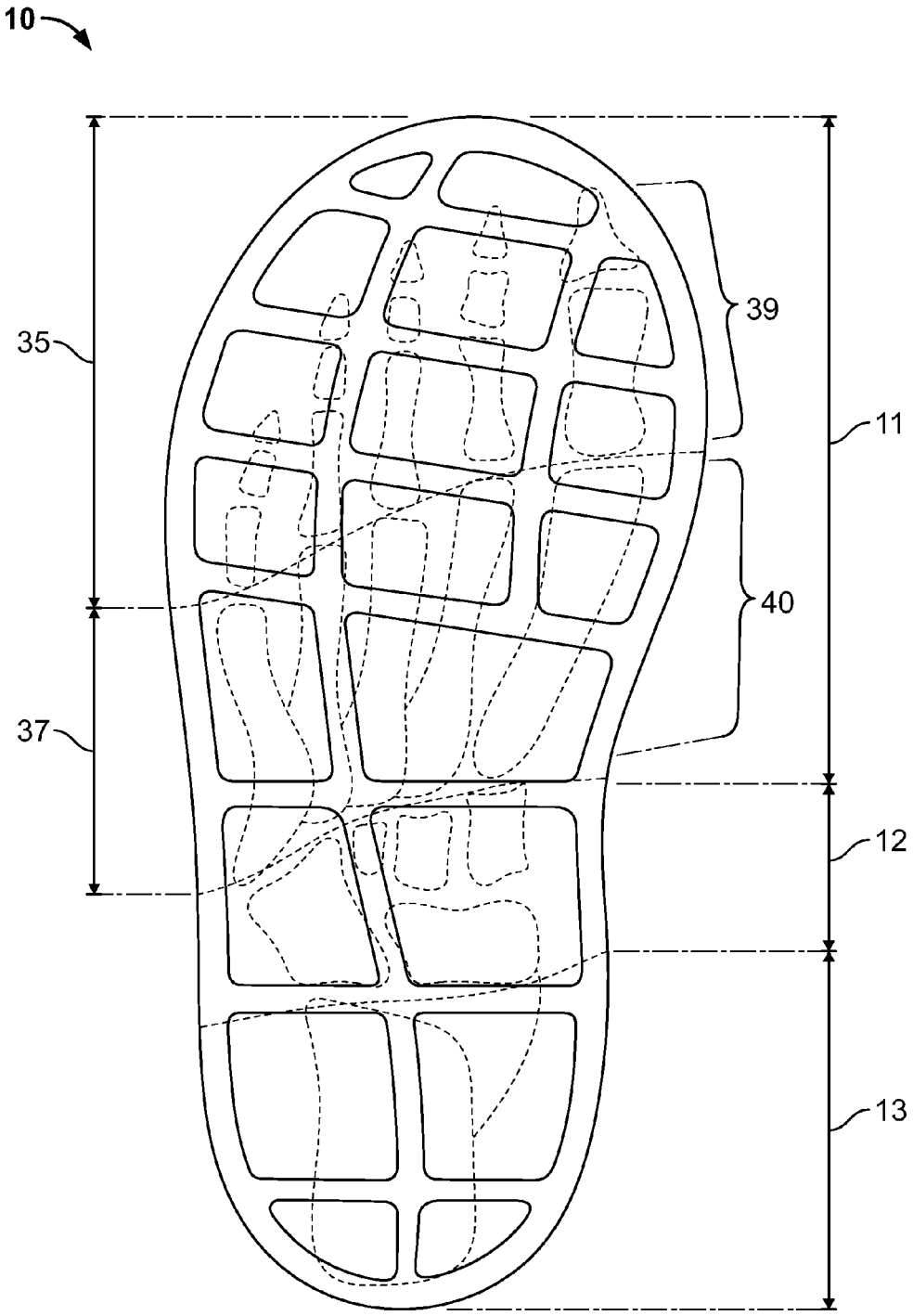
FIG. 8 is bottom plan view of a midsole structure superimposed with anatomical structure of a foot of a wearer.

For a better understanding of the article of footwear 10, FIG. 8 illustrates a bottom plan view of sole structure including a schematical representation with predetermined regions or portions substantially corresponding to the foot anatomy of a human body. For ease of explanation regarding the preferred embodiment, the skeletal structure of a human foot includes three major divisions—the forefoot, the midfoot, and the rearfoot. The forefoot includes forward phalanges interconnected to metatarsal bones. The phalanges and metatarsals bones are formed in five rows in which the medial side starts the first row across to the fifth row on the lateral side of the foot. The heads of the metatarsal bones have a generally bulbous structure that is susceptible to injury in conventional footwear. It should be recognized that the "great toe" structure is the first row, which includes two phalanges and a first metatarsal bone. The midfoot generally includes the arch formed by several interconnecting bones. Finally, the rearfoot includes the heel bone. One of ordinary skill in the art should recognize that foot anatomy also includes interconnecting muscles and other tissues, which are not shown for clarity.

Figure 1:
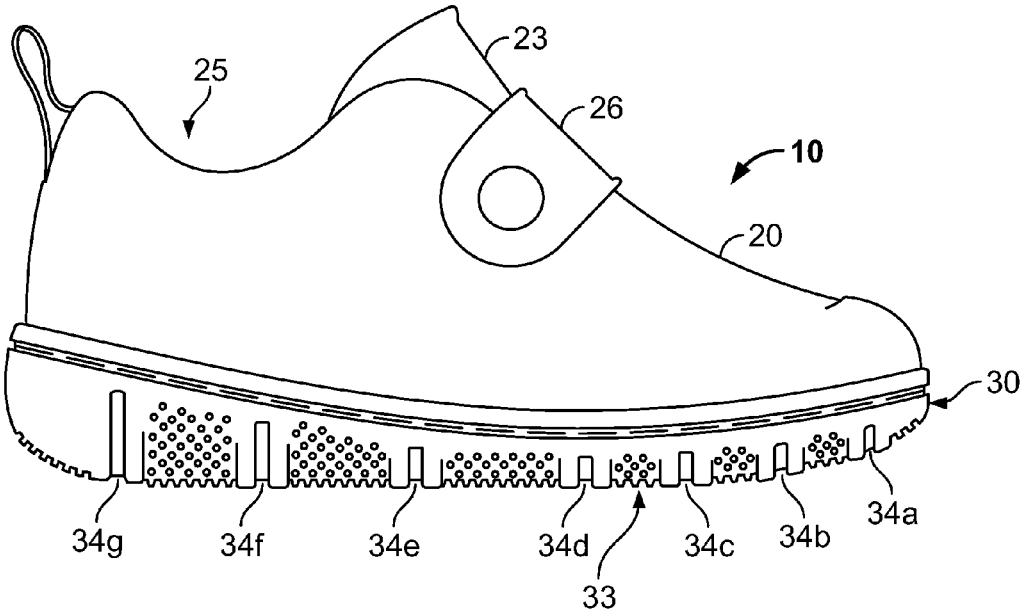
FIG. 1 is a lateral elevational view of an article of footwear according to the teachings of the present invention.
Figure 2:
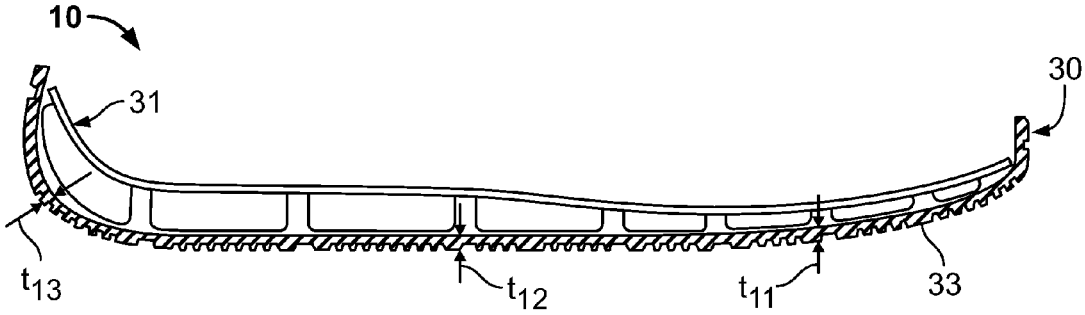
FIG. 2 is a cross-sectional view of the article of footwear of FIG. 1 along an heel-to-axis.
Figure 3:
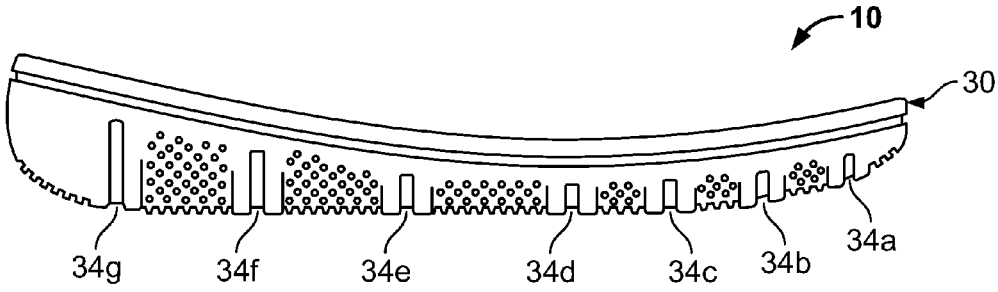
FIG. 3 is a lateral elevational view of an outsole structure of the article of footwear of FIG. 1 with the upper removed for clarity.

For purposes of reference as shown in FIG. 8, footwear 10 may be divided into three general regions: a forefoot region 11, a midfoot region 12, and a rearfoot region 13, as defined in FIGS. 1 and 2. One of ordinary skill in the art should recognize that each region generally lies beneath the respective forefoot, midfoot, and rearfoot of a wearer when shoe 10 is properly sized. Regions 11-13 are not intended to demarcate precise areas of footwear 10. Rather, regions 11-13 are intended to represent general areas of footwear 10 that provide a frame of reference during the following discussion. Although regions 11-13 apply generally to footwear 10, references to regions 11-13 may also apply specifically to upper 20, sole structure 30, or an individual component or portion within either of upper 20 or sole structure 30.

In forefoot region 32, sole structure 30 is further defined by a forwardly disposed phalanx region 35, and a rearward disposed metatarsal region 37. Phalanx region 35 includes at least a first phalanx region 39 having a distal phalanx region **39*a*, and a proximal phalanx region 39*b*. Metatarsal region 37 includes at least—a first metatarsal region 40. It should be appreciated that metatarsal region 37 includes a second through fifth metatarsal region corresponding the second through fifth metatarsal bones. It should be recognized that these regions correspond to the typical anatomy of a human foot, which does not deviate significantly from the norm. Sole structure 30** includes regions not specifically described as known to one of ordinary skill in the art.

The various material elements forming upper 20, which will be described in greater detail below, combine to provide a structure having a lateral side 21, an opposite medial side 22, and a tongue 23 that form the void within upper 20. Lateral side 21 extends through each of regions 11-13 and is generally configured to contact and cover a lateral surface of the foot. A portion of lateral side 21 extends over an instep of the foot and overlaps a lateral side of tongue 23. Medial side 22 has a similar configuration that generally corresponds with a medial surface of the foot. A portion of medial side 22 also extends over the instep of the foot and overlaps an opposite medial side of tongue 23. In addition, lateral side 21, medial side 22, and tongue 23 cooperatively form an ankle opening 25 in heel region 13 to provide the foot with access to the void within upper 20.

Tongue 23 extends longitudinally along upper 20 and is positioned to contact the instep area of the foot. Side portions of tongue 23 are secured to an interior surface of each of lateral side 21 and medial side 22. A lace 26 extends over tongue 23 and through apertures formed in lateral side 21 and medial side 22. Tongue 23 extends under strap 26 to separate strap 26 from the instep area of the foot. By increasing the tension in lace 26, the tension in lateral side 21 and medial side 22 may be increased so as to draw lateral side 21 and medial side 22 into contact with the foot. Similarly, by decreasing the tension in strap 26, the tension in lateral side 21 and medial side 22 may be decreased so as to provide additional volume for the foot within upper 20. This general configuration provides, therefore, a mechanism for adjusting the fit of upper 20 and accommodating various foot dimensions.

A variety of materials are suitable for upper 20, including the materials that are conventionally utilized in footwear uppers. Accordingly, upper 20 may be formed from combinations of leather, synthetic leather, natural or synthetic textiles, polymer sheets, polymer foams, mesh textiles, felts, non-woven polymers, or rubber materials, for example. In one arrangement, the exposed portions of upper 20 may be formed from two coextensive layers of material that are stitched or adhesively bonded together. Based upon the above discussion, the various portions of upper 20 include different combinations of materials. For example, the materials forming the tongue 23 and around ankle opening 25 may be different than the materials forming the areas of lateral side 21 and medial side 22 that extend through forefoot region 11 and midfoot region 12. In further embodiments, however, different materials may be utilized for the various areas upper 20, or upper 20 may include more than two layers of material. In joining upper 20 and sole structure 30, adhesives, stitching, or a combination of adhesives and stitching may be utilized. In this manner, upper 20 is secured to sole structure 30 through a substantially conventional process.

Sole structure 30 includes an insole 31, a midsole 32, and an outsole 33. Outsole 33 includes a plurality of outsole elements that are formed in the lower surface of the outsole. Outsole 33 is an exterior surface of the footwear 10 to provide wear-resistance and ground-engagement. Suitable materials for outsole 33 include any of the conventional rubber materials that are utilized in footwear outsoles, such as carbon black rubber compound. Outsole structure 33 has a cupped configuration to form an internal cavity or void. Accordingly, midsole 32 is received within the cavity of the outsole structure 33 for performance benefits. Additionally, the outsole structure 33 acts as a protective cover for the midsole 32. Outsole structure 33 provides a cupped feature at least to the connection interface between the upper 20. In one arrangement, outsole structure 33 is constructed of a translucent or transparent material. The outsole structure 33 is substantially transparent providing clear visibility to the contents in the void of the structure 33. In addition, the outsole material alters or enhances the coloration or tint of the midsole to accentuate look of the midsole to the wearer or other individual.

Outsole structure 33 has thickness (see FIG. 2) so as to provide for the wearer to sense the ground forces via the midsole 33, while providing ground engagement and wear resistance. The thickness of outsole structure 33 is generally defined as the dimension that extends between inner surface and the lower surface. In one arrangement, the thickness of the outsole 33 may vary along the longitudinal length of outsole 33. The thickness is depicted graphically in FIG. 2 as thickness dimensions t11-t13. Dimension t11, defined in forefoot region 11, may be approximately 2-3 millimeters and may range from 1 to 5 millimeters, for example. Dimension t12, provided in midfoot region 12, may be approximately 3 millimeters and may range from 1 to 8 millimeters, for example. Similarly, dimension t13, provided in rearfoot region 13, may be approximately 2-3 millimeters and may range from 1 to 5 millimeters, for example. The thickness of outsole 33 may, for example, increase in directions that extend from forefoot region 11 towards rearfoot region 13 or be the same thickness. One skilled in the relevant art will recognize, however, that a variety of thickness dimensions and variations will be suitable for outsole 33.

In one arrangement, regions of outsole 33 that exhibit a relatively thin thickness will, in general, possess more flexibility or sensory input to the wearer than regions of outsole 33 that exhibit a greater thickness. Variations in the thickness of outsole 33 may be utilized to modify the flexibility of sole structure 30 in specific areas. For example, forefoot region 11 may be configured to have relatively high flexibility by forming outsole 33 with a lesser thickness. A relatively less flexibility may be imparted to midfoot region 12 by forming outsole 33 with a greater thickness than in the forefoot region 11. Nevertheless, other variations of the thickness are possible.

Insole structure 31 is positioned within upper 20 in order to contact the plantar (lower) surface of the foot and enhance the comfort of footwear 10. In one arrangement, midsole structure 32 is secured to a lower surface of insole 31 and is positioned to extend under the foot during use. Among other purposes, midsole 32 attenuates ground reaction forces and absorbs a portion of energy (i.e., imparts partial cushioning) when walking or running, for example. Suitable materials for midsole 32 are any of the conventional polymer foams that are utilized in footwear midsoles, including ethylvinylacetate and polyurethane foam. The insole structure 31 may have a stroble material sewn into the upper 20.

A conventional footwear midsole is a unitary, polymer foam structure that extends throughout the length of the foot and may have more stiffness or inflexibility that inhibits the natural motion of the foot. In contrast with the conventional footwear midsole, midsole 32 has a distinct segmented or podded structure that imparts relatively high flexibility and movement to the foot of a wearer. The flexible structure of midsole 32 is configured to complement the natural motion of the foot during running or other activities, and may impart a feeling or sensation of barefoot running Midsole 32 attenuates ground reaction forces and absorbs energy to cushion the foot and decrease the overall stress upon the foot and allows the wearer to sense the ground.

Insole 31 an top surface 41 and an opposite lower surface 42. In one arrangement, top surface 41 is positioned adjacent to upper 20 and may be secured directly to upper 20, thereby providing support for the foot. Top surface 41 may be contoured to conform to the natural, anatomical shape of the foot. Accordingly, the area of top surface 41 that is positioned in rearfoot region 13 may have a greater elevation than the area of top surface 41 in forefoot region 11. If desired, top surface 41 may form an arch support area in midfoot region 12, and other areas of top surface 41 may be generally raised to provide a depression for receiving and seating the foot. In further embodiments, top surface 41 may have a non-contoured configuration.

Figure 7:
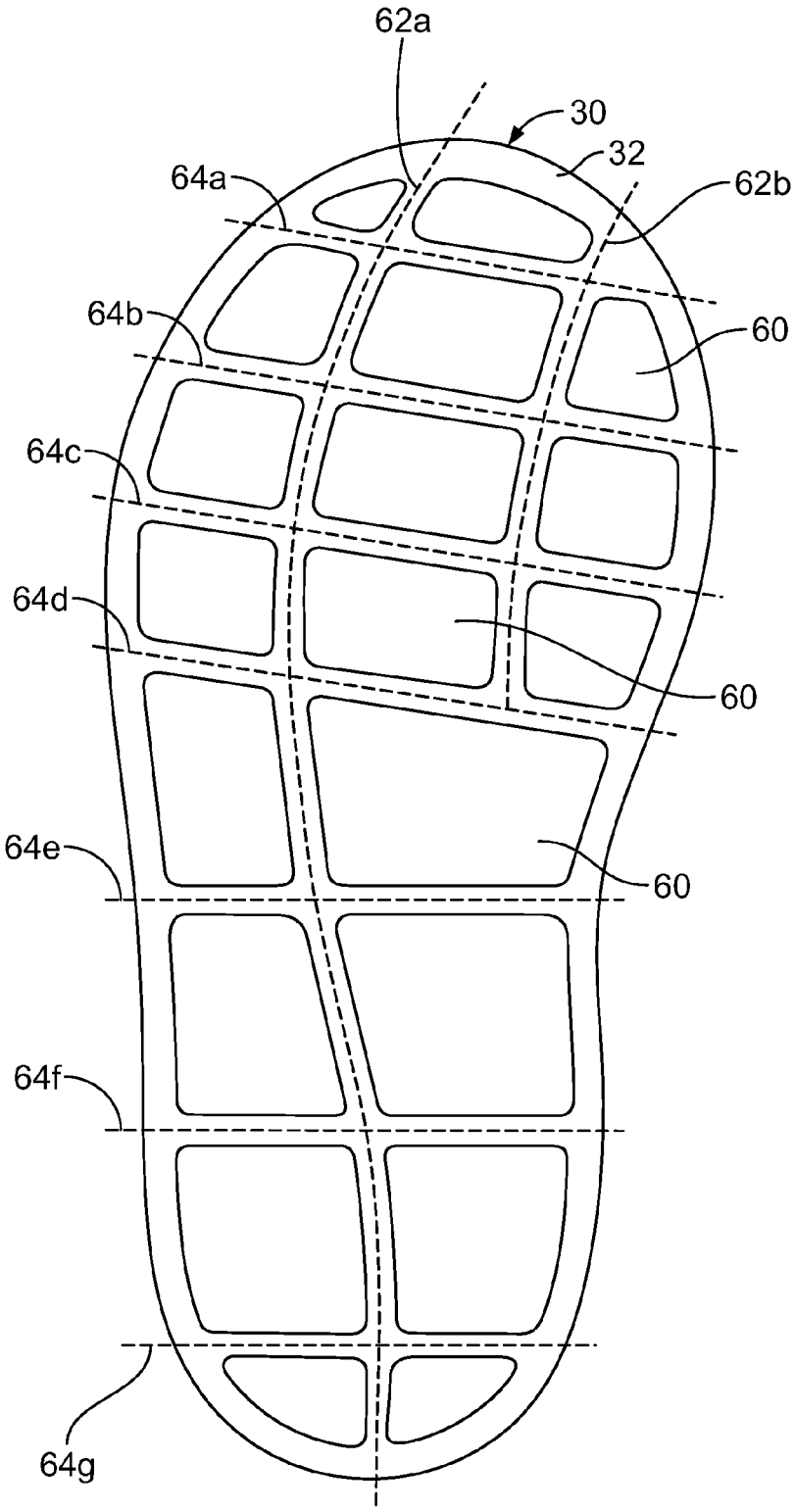
FIG. 7 is a bottom plan view of a midsole structure of the footwear of FIG. 10.

Midsole 32 is formed form a plurality of individual, separate sole elements 60 that are separated by a plurality of heel-to-toe flexion lines or flexion regions 62*a*-62*b* and medial-to-lateral flexion lines or flexion regions 64*a*-64*g*. Sole elements 60 are discrete portions of midsole 32 that extend downward from insole 31. In addition, sole elements 60 are secured to the insole 31 or may be formed integral with insole 31. The shape of each sole element 60 is determined by the positions of the various flexion lines and the anatomical flexibility desired. As depicted in FIG. 7, flexion lines 62*a* and 62*b* extend in a longitudinal direction along sole structure 30, and flexion lines 64*a*-64*g* extend in a generally lateral direction. This positioning forms a majority of sole elements 60 to exhibit a generally square, rectangular, or trapezoidal shape. The rearmost sole elements 60 have a quarter-circular shape due to the curvature of sole structure 30 in rearfoot region 13.

Figure 5:
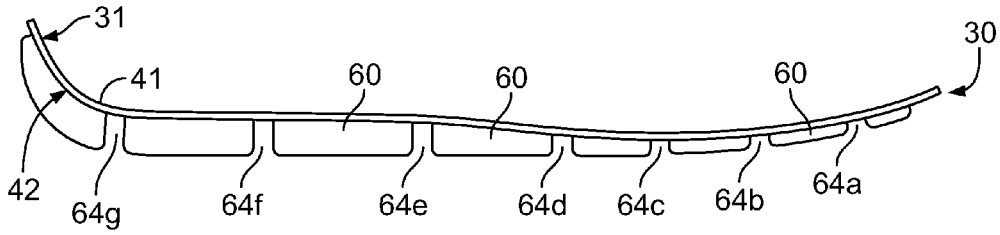
FIG. 5 is an elevational view of an insole-midsole structure of the article of footwear of FIG. 1.

With reference to FIG. 5, the thickness of the sole elements 60 may vary in the regions 11-3. Specifically, in forefoot region 11, the thickness may be approximately 3 millimeters and may range from 1 to 4 millimeters, for example. In the midfoot region 12, the thickness may be approximately 5 millimeters and may range from 4 to 6 millimeters, for example. Similarly, in rearfoot region 13, the thickness may be approximately 6 millimeters and may range from 4 to 8 millimeters, for example. The thickness of the midsole 31 may, for example, increase in directions that extend from forefoot region 11 towards rearfoot region 13 or be the same thickness in one arrangement. One skilled in the relevant art will recognize, however, that a variety of thickness dimensions and variations will be suitable for midsole 32 and that the thickness may vary accordingly.

With reference to FIGS. 5, 7, 8, the shape of each sole element 60 can be provided by the positions of the various flexion lines 62*a*-62*b* and 64*a*-64*g* or spaces that extend between sole elements 51. Midsole 32 includes a plurality of flexion lines 62*a*-62*b* and 64*a*-64*g* that enhance the flex properties of sole structure 30. The positions, orientations, and width of flexion lines are selected to provide specific degrees of flexibility in selected areas and directions. That is, flexion lines of the midsole 32 may be utilized to provide the individual with a sensation of natural, barefoot running In contrast with barefoot running, however, sole structure 30 attenuates ground reaction forces and absorbs energy to cushion the foot and decrease the overall stress upon the foot.

Flexion lines 62*a*-62*b* also increase the flexibility of sole structure 30 by forming a segmented configuration in midsole 32. Lateral flexibility of sole structure 30 (i.e., flexibility in a direction that extends between a lateral side and a medial side) is provided by flexion lines 62*a* and 62*b*. Flexion line 62*a* extends longitudinally through all three of regions 11-13. Although flexion line 62*a* may have a straight or linear configuration, it depicted as having a generally curved arrangement. In forefoot region 11 and midfoot region 12, flexion line 62*a* is spaced inward from the lateral side of sole structure 30, and flexion line 62*a* is centrally-located in forefoot region 13. Flexion line 62*b*, which is disposed in forefoot region 11 and a portion of midfoot region 12, is centrally-located and extends in a direction that is generally parallel to flexion line 62*a*.

With reference to FIGS. 7 and 8, longitudinal flexibility of sole structure 30 (i.e., flexibility in a direction that extends between regions 11 and 13) is provided by flexion lines 64*a*-64*g*. Flexion lines 64*a*-64*e* are positioned in forefoot region 11. Flexion line 64*e* generally extends along the bone-muscle joint between forefoot region 11 and midfoot region 12. Flexion line 64*f* generally extends along the muscle joint between midfoot region 12 and rearfoot region 13, and flexion line 64*g* is positioned in rearfoot region 13. Flexion lines 64*a*-64*e* are generally parallel to each and extend in a medial-lateral direction.

The positions and orientations of flexion lines 64*a*-64*g* are selected to complement the natural motion of the foot during the running cycle. In general, the motion of the foot during running proceeds as follows: Initially, the heel strikes the ground, followed by the ball of the foot. As the heel leaves the ground, the foot rolls forward so that the toes make contact, and finally the entire foot leaves the ground to begin another cycle. During the time that the foot is in contact with the ground, the foot typically rolls from the outside or lateral side to the inside or medial side, a process called pronation. That is, normally, the outside of the heel strikes first and the toes on the inside of the foot leave the ground last. Flexion lines 64*a*-64*g* promotes a neutral foot-strike position and complements the neutral forward roll of the foot as it is in contact with the ground. Flexion lines 62*a* and 62*b* provide lateral flexibility to permit the foot to pronate naturally during the running cycle.

The conventional sole structure, as discussed above, may have a relatively stiff or inflexible construction that inhibits the natural motion of the foot. For example, the foot may attempt to flex during the stage of the running cycle when the heel leaves the ground. The combination of the inflexible midsole construction and a conventional heel counter operates to resist flex in the foot.

Figure 4:
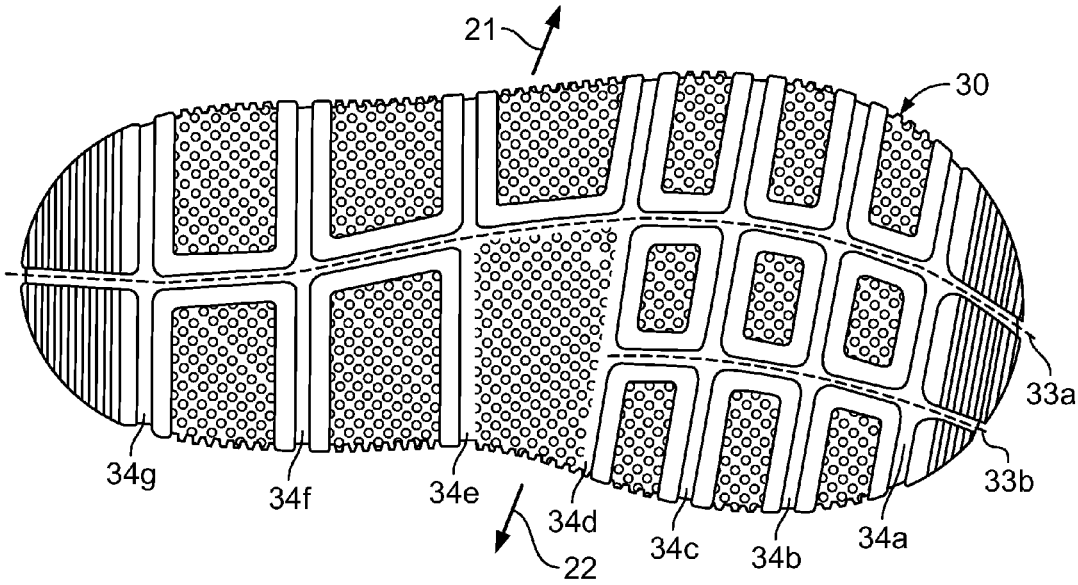
FIG. 4 is a bottom plan view of the sole structure of the article of footwear of FIG. 1.
Figure 6:
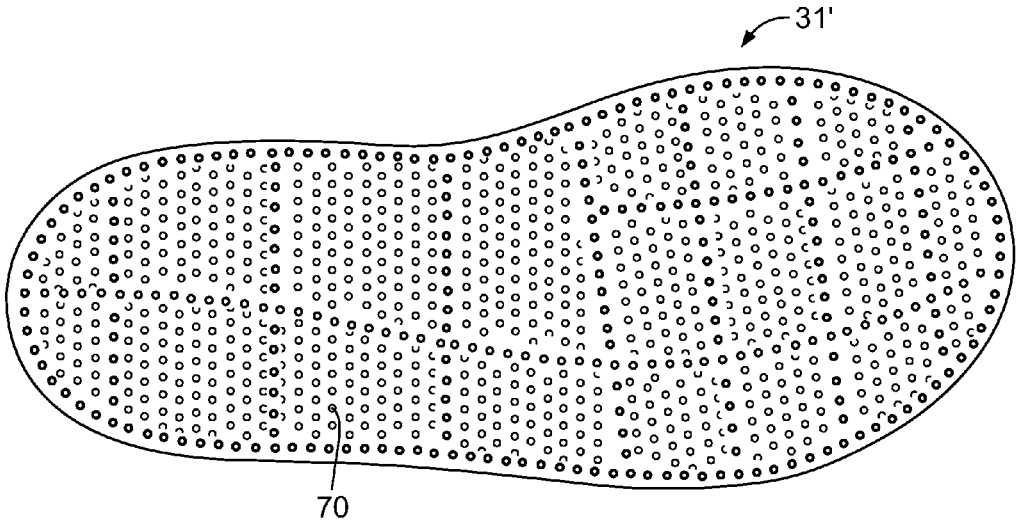
FIG. 6 is a top plan view of one embodiment of an insole structure of the footwear of FIG. 1.
Figure 9:
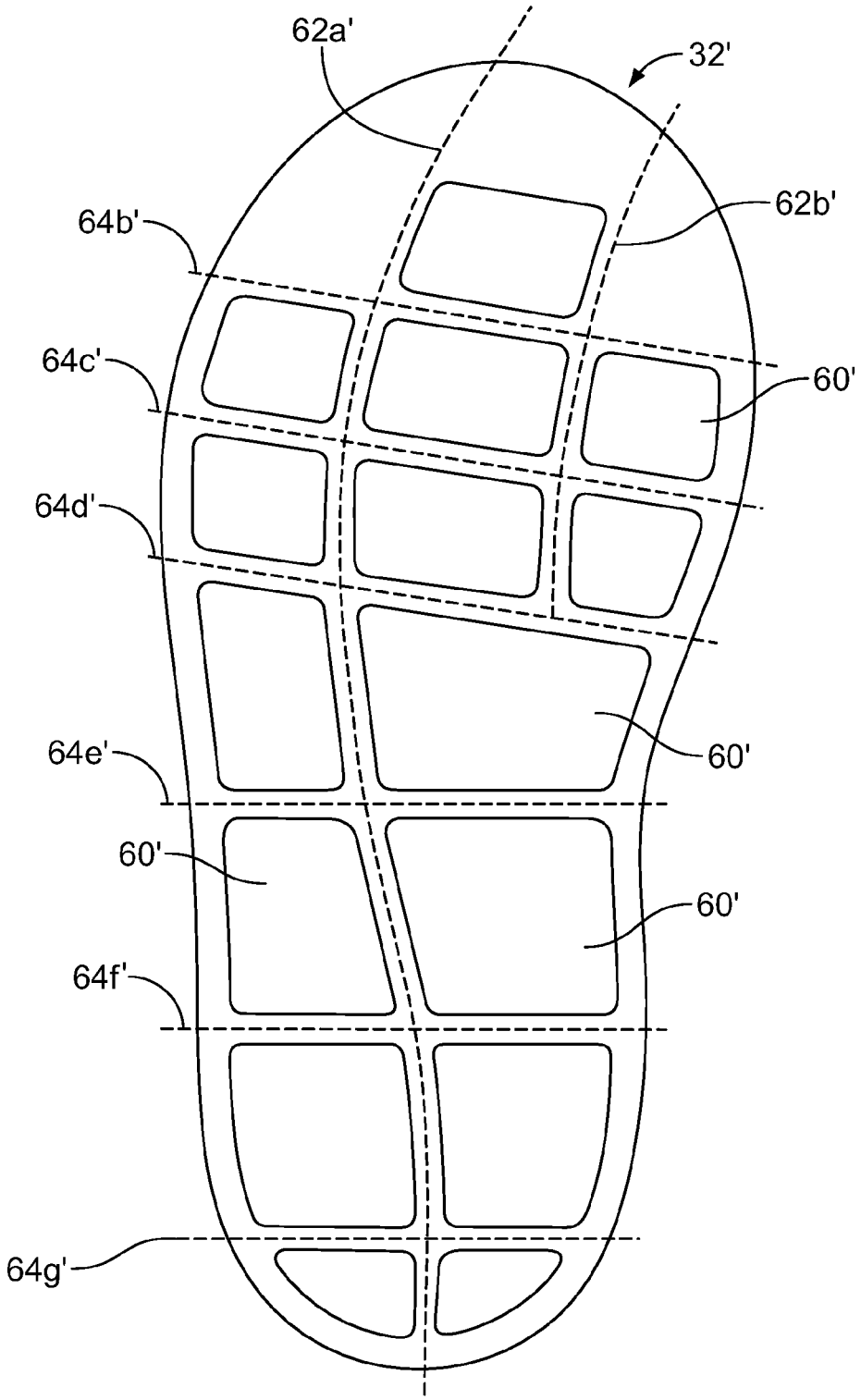
FIG. 9 is a bottom plan view of an alternative midsole structure.
Figure 10:
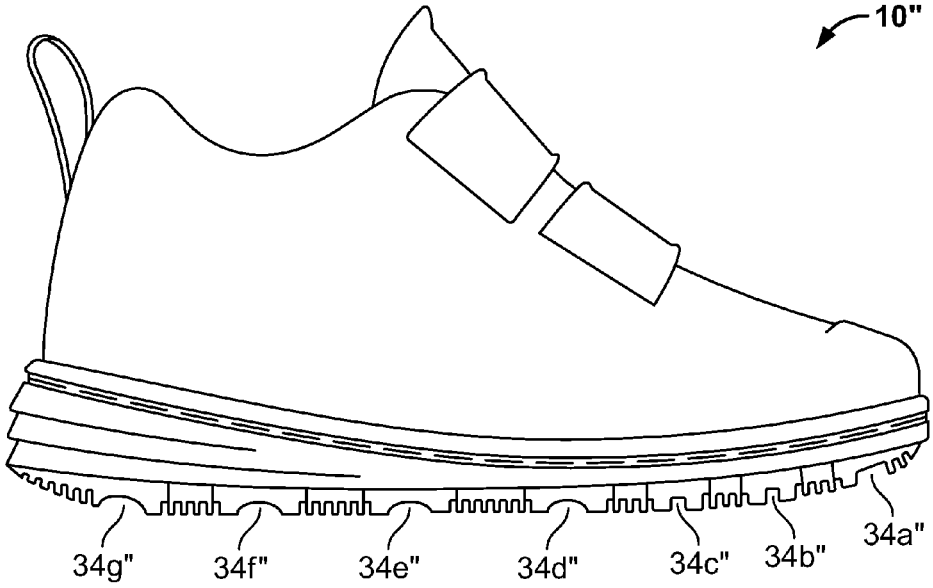
FIG. 10 is a lateral elevational view of an article of footwear with the midsole structure of FIG. 1, alternative outsole and upper structures.
Figure 11:
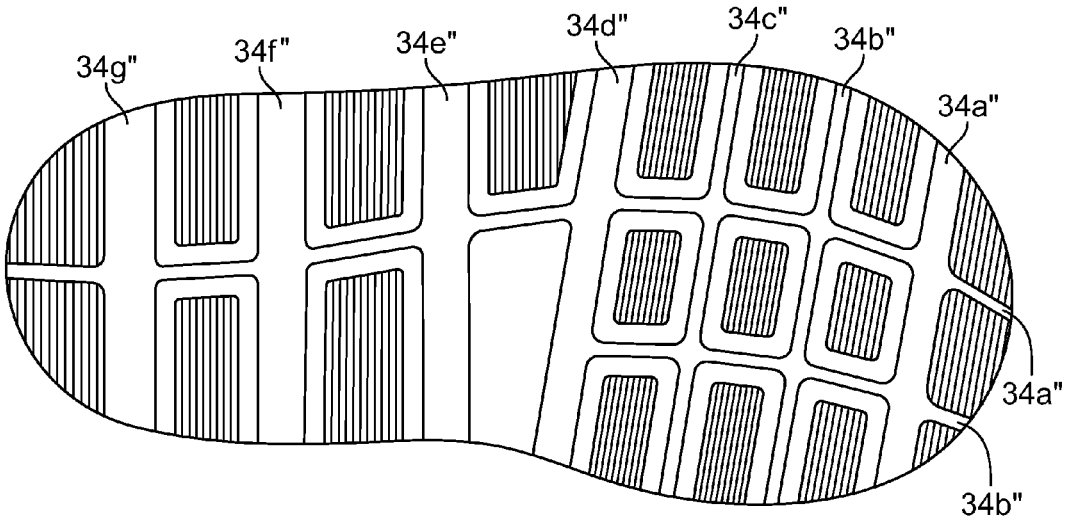
FIG. 11 is a bottom plan view of an alternative outsole structure for an article of footwear.

The overall flexibility of sole structure 30 may be enhanced through the configuration of outsole 33. With reference to FIG. 4, a lower surface of outsole 33 is depicted as having a plurality of grooves 33*a*-33*b* and grooves 34*a*-34*g* that generally correspond with the positions and configuration of midsole flexion lines 62*a*-62*b* and 64*a*-64*g*, respectively. Groove 33*a* extends longitudinally through substantially the entire length of outsole 33 and generally corresponds with the position of flexion line 62*a*. Groove 33*b* extends longitudinally through a portion of the length of outsole 33 and generally corresponds with the position of midsole flexion line 62*b*. Similarly, grooves 34*a*-34*g* extend laterally from a medial side to a lateral side of outsole 33 and generally correspond with the positions of midsole flexion lines 64*a*-64*g*. This configuration provides additional flexibility to sole structure 30 and enhances the segmented configuration. A similar configuration is depicted in FIGS. 9-11, a lower surface of outsole 33' is depicted as having a plurality of grooves 33*a*"-33*b*" and grooves 34*a*"-34*g*" that generally correspond with the positions and configuration of midsole flexion lines 62*a*' and 62*b*' and 64*b*'-64*g*' of midsole 32'. With reference to FIG. 6, insole 31' may be a plurality of apertures 70 therein for mounting of the sole elements 60 at the specific locations.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. An article of footwear, comprising:

an upper and a sole structure secured to the upper, the sole structure comprising a translucent outsole unit and a plurality of discrete sole elements disposed within the outsole unit, the sole elements being separated by a plurality of flexion regions, the plurality of flexion regions including:

a first flexion region in a longitudinal direction with respect to the footwear, the first flexion region extending through an entire length of the sole structure, the first flexion region being spaced inward from a lateral side of the sole structure in at least a forefoot region of the footwear;

a second flexion region that extends in the longitudinal direction, the second flexion region extending through a portion of the length of the sole structure and ending in a metatarsal region of the sole structure;

a plurality of third flexion regions that extend laterally from the medial side to the lateral side of the sole structure; and wherein the sole elements have varying increasing thickness along the length of the footwear and wherein the sole structure including an insole having a plurality of apertures for mounting of the sole elements.

2. The article of footwear according to claim 1, wherein the first flexion region has a curved configuration.

3. The article of footwear according to claim 1, wherein the second flexion region is positioned in at least the forefoot region of the footwear, and the second flexion region is approximately centered between the lateral side and the medial side.

4. The article of footwear according to claim 1, wherein the outsole unit includes a first set of grooves corresponding to the location of at least the first flexion region of the sole structure.

5. The article of footwear recited in claim 4, wherein the outsole unit includes a second set of groove corresponding to the location of the at least the third flexion regions.

6. The article of footwear according to claim 1, wherein the thickness of the outsole unit varies along the length of the footwear.

7. The article of footwear according to claim 1, wherein the sole elements are attached to the insole.

8. The article of the footwear according to claim 7 wherein the insole includes a secondary plurality of apertures following one of the flexion regions.

9. The article of footwear recited in claim 1, wherein the sole structure has a first overall thickness in a forefoot region of the footwear, and the sole structure has a second overall thickness in a rearfoot region of the footwear, the first thickness being less than the second thickness.

* * * * *